US010684032B2

(12) United States Patent
Havard, Jr. et al.

(10) Patent No.: US 10,684,032 B2
(45) Date of Patent: Jun. 16, 2020

(54) SENSOR COUPLING VERIFICATION IN TANDEM COMPRESSOR UNITS

(71) Applicant: Lennox Industries Inc., Richardson, TX (US)

(72) Inventors: Harold Gene Havard, Jr., Carrollton, TX (US); Rosa Maria Leal, Irving, TX (US); Anuradha Sundararajan, Allen, TX (US)

(73) Assignee: Lennox Industries Inc., Richardson, TX (US)

( * ) Notice: Subject to any disclaimer, the term of this patent is extended or adjusted under 35 U.S.C. 154(b) by 1078 days.

(21) Appl. No.: 14/642,728

(22) Filed: Mar. 9, 2015

(65) Prior Publication Data

US 2016/0265798 A1 Sep. 15, 2016

(51) Int. Cl.

| | |
|---|---|
| ***F24F 11/00*** | (2018.01) |
| ***F25B 31/00*** | (2006.01) |
| ***F24F 11/30*** | (2018.01) |
| ***F25B 49/00*** | (2006.01) |
| *F24F 110/00* | (2018.01) |
| *F24F 11/32* | (2018.01) |

(52) U.S. Cl.

CPC ..... *F24F 11/30* (2018.01); *F25B 49/00* (2013.01); *F24F 11/32* (2018.01); *F24F 2110/00* (2018.01); *F25B 2400/075* (2013.01); *F25B 2700/1933* (2013.01); *F25B 2700/21152* (2013.01)

(58) Field of Classification Search

CPC ..... F24F 11/0076; F24F 11/001; F24F 2011/0052; F25B 31/00

See application file for complete search history.

(56) References Cited

U.S. PATENT DOCUMENTS

| | | | | |
|---|---|---|---|---|
| 5,230,222 | A * | 7/1993 | Erbs | F25B 31/002 62/192 |
| 7,412,842 | B2 * | 8/2008 | Pham | F04C 28/00 62/228.5 |
| 2003/0077179 | A1 * | 4/2003 | Collins | F04B 49/065 417/63 |
| 2003/0161731 | A1 * | 8/2003 | Blotenberg | F04D 27/0269 417/2 |
| 2005/0235660 | A1 * | 10/2005 | Pham | F04C 28/00 62/126 |
| 2009/0095002 | A1 * | 4/2009 | McSweeney | F25B 49/022 62/216 |
| 2009/0119036 | A1 * | 5/2009 | Jayanth | F04B 49/065 702/60 |
| 2011/0070100 | A1 * | 3/2011 | McSweeney | F04B 35/04 417/53 |
| 2011/0264409 | A1 * | 10/2011 | Jayanth | F04B 35/04 702/182 |
| 2013/0166231 | A1 * | 6/2013 | Jayanth | F04B 49/065 702/60 |
| 2013/0177393 | A1 * | 7/2013 | Sishtla | F25B 1/10 415/1 |

(Continued)

*Primary Examiner* — Nelson J Nieves
*Assistant Examiner* — Meraj A Shaikh
(74) *Attorney, Agent, or Firm* — Winstead PC

(57) ABSTRACT

Provided are a method and apparatus for verifying or correcting the temperature sensor and compressor pairings within the HVAC system control logic, indicating that a sensor is logically paired with the specific compressor, from amongst a tandem compressor group, to which the sensor is coupled.

24 Claims, 3 Drawing Sheets

(56) References Cited

U.S. PATENT DOCUMENTS

2013/0272840 A1* 10/2013 Fujioka ..... F04D 27/00
415/1
2015/0300347 A1* 10/2015 Galeotti ..... F04D 27/02
417/53

* cited by examiner

200
RECEIVE INPUT INITIATING SENSOR PAIRING VERIFICATION 201
ENERGIZE AN UNPAIRED COMPRESSOR 202
SENSOR DATA RECEIVED? 203
NO
FAILURE ALERT AND END 208
YES
COMPARE RECEIVED DATA 204
GENERATE PAIRING SIGNAL TO SET CONTROL LOGIC 205
ADDITIONAL UNPAIRED COMPRESSOR? 206
NO
SYSTEM DEMAND? 209
NO
TO STEP 301
YES
YES
DE-ENERGIZE COMPRESSOR 207
RETURN TO NORMAL SYSTEM OPERATION 210

SENSOR COUPLING VERIFICATION IN TANDEM COMPRESSOR UNITS

BACKGROUND

Field of the Invention

This application is directed, in general, to heating, ventilation, and air conditioning systems (HVAC) and, more specifically, to systems and methods for ensuring that sensed data from a sensor logically paired with the compressor, from among a set of two, or more, compressors configured for tandem operation, to which the sensor is physically coupled.

Description of the Related Art

Some HVAC systems utilize one or more tandem compressor arrangements. Tandem compressors may share common refrigerant piping. Specifically, the suction pipe leg for each compressor configured for tandem operation may fork off from a single, common suction pipe. Similarly, the discharge pipe leg for each compressor configured for tandem operation may merge into a single, common discharge pipe. The tandem compressor arrangement may allow for efficient HVAC system operation by providing greater ability to match partial load demands on the HVAC system while still allowing for high overall system capacity during full load operation.

One disadvantage of the tandem compressor arrangement is that the shared piping among the tandem compressors, and attendant merged refrigerant flow, can make monitoring specific compressor operation and identifying specific compressor failures difficult. For example, the tandem compressor arrangement can render a discharge pressure switch incapable of identifying the specific failing compressor among the tandem compressors when an over-pressure condition is sensed. This may be due to the merged discharge piping among the tandem compressors. The discharge pressure switch may sense the combined pressure from all compressors configured for tandem operation, and lack a means for discerning the specific compressor, or compressors, causing the failure condition.

In HVAC systems utilizing a tandem compressor arrangement, it is critical for individual monitoring of the performance and operation of each compressor of tandem compressor arrangement that the refrigerant discharge temperature exiting each of the tandem compressors be accurately sensed. The HVAC systems provided with tandem compressors commonly place a temperature sensor at, or near, the discharge port of each compressor of the tandem compressor arrangement to sense the refrigerant discharge temperature specific to each compressor of the tandem compressor arrangement.

Unfortunately, the proximity of tandem compressors to one another within the compressor section of an HVAC system creates the possibility that these discharge temperature sensors may be installed on the incorrect compressor. Incorrect installation may destroy the ability of the HVAC system to monitor the performance the individual compressors configured for tandem operation since the temperature sensor and compressor pairing in the HVAC system control logic will not match the physical pairing of the components.

SUMMARY

In accordance with the present invention, a method and apparatus for verifying one or more couplings of compressors with sensors within an HVAC system having more than one compressor configured to share common refrigerant piping are provided.

A first apparatus is provided for verifying one or more sensors are coupled to an associated compressor of an HVAC system. The HVAC system may comprise a first compressor having a first discharge pipe leg coupled to a discharge port of the first compressor and a second compressor having a second discharge pipe leg coupled to a discharge port of the second compressor, wherein the second discharge pipe leg merges with the first discharge pipe leg to form a common discharge pipe shared by the first and second compressors. The HVAC system may further comprise a first sensor coupled to the first discharge pipe leg, the first sensor configured to transmit a first signal directly or via one or more intermediate devices to a location remote to the first sensor. The first signal may indicate one or more temperatures of refrigerant within the first discharge pipe leg. A controller may be operably coupled to switch each of the first and second compressors between energized and de-energized states and to receive the first signal which may indicate one or more temperatures of refrigerant within the first discharge pipe leg of the first compressor. The controller may cause a temperature increase of the refrigerant within the first discharge pipe leg of the first compressor. The controller may receive from the first sensor the first signal which may indicate one or more temperatures of refrigerant within the first discharge pipe legs. The controller may determine whether the first signal indicates one or more temperatures above a threshold value. If the first signal indicates one or more temperatures above the threshold value, the controller may generate a first pairing signal to indicate that the first sensor is coupled with the first compressor. If the first signal indicates one or more temperatures below the threshold value, the controller may generate a second pairing signal to indicate that the first sensor is not coupled with the first compressor.

A first method of verifying the couplings of one or more sensors to an associated compressor of an HVAC system is provided. A first discharge pipe leg may couple to a discharge port of a first compressor. A second discharge pipe leg may couple to a discharge port of a second compressor. The first and second discharge pipe legs may couple to a common discharge pipe shared by the first and second compressors. A first sensor may couple to the first discharge pipe leg, the first sensor may transmit a first signal directly or via one or more intermediate devices to a location remote to the first sensor. The first signal may indicate one or more temperatures of refrigerant within the first discharge pipe leg. A controller may operably couple to the first and second compressors to switch each of the first and second compressors between energized and de-energized states. The controller may couple to the first sensor to receive the first signal which may indicate one or more temperatures of refrigerant within the first discharge pipe leg. The controller may cause a temperature increase of the refrigerant within the first discharge pipe leg of the first. The controller may receive the first signal from the first sensor which may indicate one or more temperatures of refrigerant within the first discharge pipe leg. The controller may determine whether the first signal indicates one or more temperatures above a threshold value. If the first signal indicates one or more temperatures above the threshold value, the controller may generate a first pairing signal indicating the first sensor is paired with the first compressor. If the first signal indicates one or more temperatures below the threshold value, the controller may generate a second pairing signal indicating the first sensor is not paired with the first compressor.

Advantageously, the apparatus and method provided may prevent data received from a system sensor, for use in monitoring compressor performance, from being associated to the wrong compressor from among the compressors comprising a tandem compressor group. Pairing the data provided by a sensor with the correct compressor ensures that HVAC system safeguards for protecting the compressors from operation in unsafe conditions will be effective. Further, implementation of the methods provided may provide a diagnostic function, identifying inoperative, or improperly coupled, components within the HVAC system.

BRIEF DESCRIPTION OF THE DRAWINGS

For a more complete understanding of the present invention and the advantages thereof, reference is now made to the following Detailed Description taken in conjunction with the accompanying drawings, in which.

DETAILED DESCRIPTION

Figure 1:
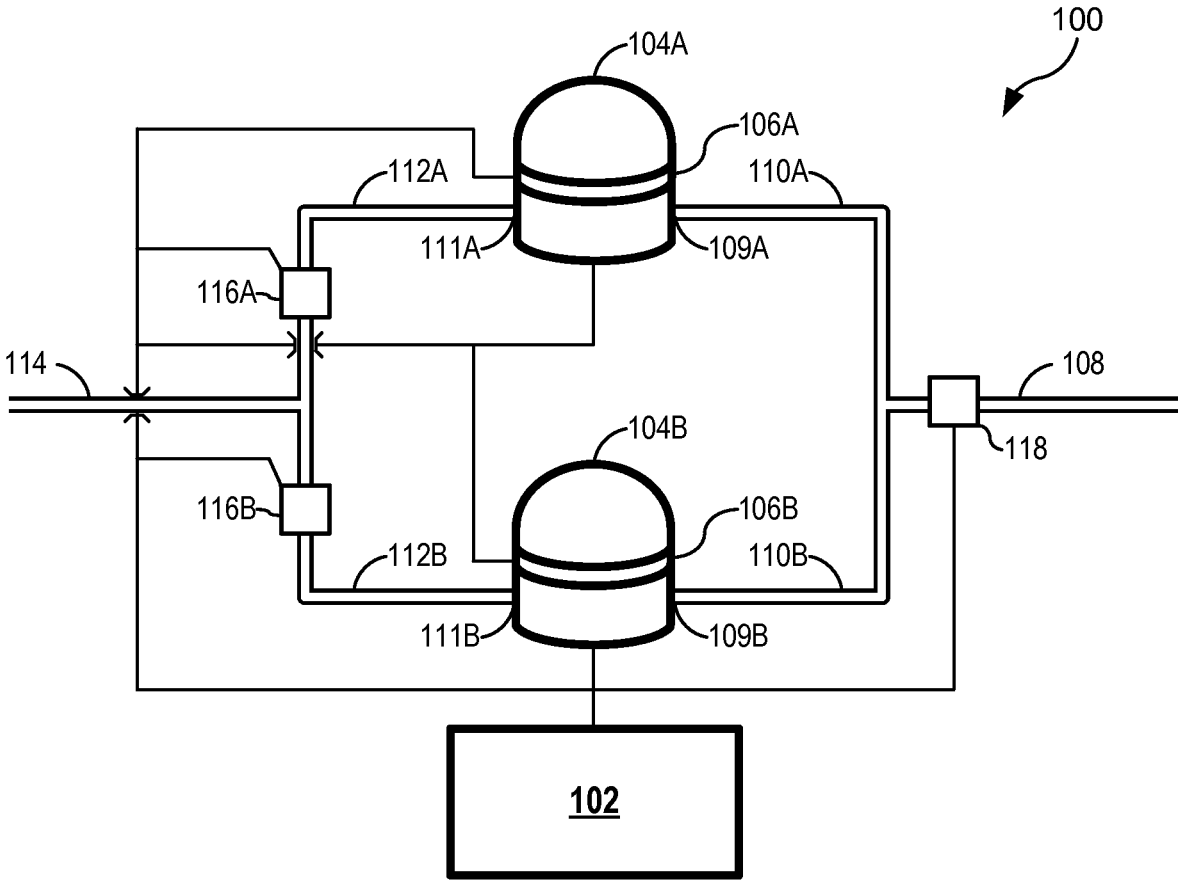
FIG. 1 is a block diagram of the compressor section of an HVAC system 100.

A compressor section of an HVAC system 100 that may implement the methods provided herein is shown in FIG. 1. As shown, in an embodiment, the HVAC system 100 may include a controller 102, a compressor 104A, a compressor 104B, a crank case heater 106A, a crank case heater 106B, a temperature sensor 116A, a temperature sensor 116B, and a pressure sensor 118. In alternative embodiments, the HVAC system 100 may be provided with additional, fewer, or different components. For example, in an embodiment, the HVAC system 100 may be provided with: additional compressors 104; additional, or fewer, sensors 116, 118; and/or additional, fewer, or no crank case heaters 106.

The HVAC system 100 components shown may be part of a system of components configured for vapor compression cycle operation, comprising, at least, a condenser, a metering device, and an evaporator. The HVAC system 100 may provide heating, ventilation, or cooling supply air to a space. The HVAC system 100 may be used in residential or commercial buildings, and in refrigeration. The HVAC system 100 is not necessarily capable of all of heating, ventilation, and air conditioning operations.

The HVAC system 100 may be configured to operate in response to both full load and partial load demands. Full load demand may require operation of both of the compressors 104A, B while partial load demand may require operation of only one of among the compressors 104A, B. In an embodiment, during partial load operation, the HVAC system 100 may be configured to energize only a particular compressor, the compressor 104A perhaps. In such embodiments, the compressor 104A may be described as the partial load compressor. In alternative embodiments, the HVAC system 100 may not be provided with a particular compressor 104A, B designated for use in response to all partial load demand. In such alternative embodiments, either of the compressors 104A of 104B may be energized in response to a partial load demand on the HVAC system 100.

As shown in FIG. 1, the HVAC system 100 may be provided with a piping arrangement comprising of a common suction pipe 108, a suction pipe leg 110A, a suction pipe leg 110B, a discharge pipe leg 112A, a discharge pipe leg 112B, and a common discharge pipe 114. In the embodiment shown, the HVAC system 100 may receive low pressure gaseous refrigerant from an evaporator via the common suction pipe 108. The HVAC system 100 may compress the received refrigerant and discharge high pressure, high temperature gaseous refrigerant to a condenser via the common discharge pipe 114. In alternative embodiments, the HVAC system 100 may be provided with a piping arrangement different from that shown in FIG. 1, and configured to accommodate the specific components provided.

The HVAC system 100 may comprise a controller 102 for controlling, monitoring, and configuring the HVAC system 100 components and operations. The controller 102 may selectively energize, or de-energize, the HVAC system 100 components. The controller 102 may be configured to alert users of operational statuses, conditions, and component failures of the HVAC system 100. The controller 102 may be connected to the HVAC system 100 components via a wired or wireless connection. The controller 102 may be provided with hardware, software, or firmware.

In an embodiment, the controller may be provided with one, or more, internal components configured to perform one, or more, of the functions of a memory, a processor, and/or an input/output (I/O) interface. The controller 102 memory may store computer executable instructions, operational parameters for system components, predefined ranges, or threshold values for HVAC system 100 operational conditions, and the like. The controller 102 processor may execute instructions stored within the controller 102 memory. The controller 102 I/O interface may operably connect the controller 102 to the HVAC system 100 components, such as the compressors 104A, B, the temperature sensors 116A, B, the pressure sensor 118, the crank case heaters 106A, B, as well as other components that may be provided.

The controller 102 may be provided with logic for monitoring operation and performance of the HVAC system 100 components. The controller 102 may be provided with logic for comparing received data that may be sensed, or calculated, by one or more sensors 116, 118. The data received by the controller 102 may comprise signals from one or more remote devices, such as the temperature sensors 116A, B and 118, described below. The data received by the controller 102 may be received directly from one or more remote devices or may be received indirectly through one or more intermediate devices, such as a signal converter, a processor, an input/output interface, an amplifier, a conditioning circuit, a connector, and the like.

The controller 102 may be provided with logic for reconfiguring aspects of the HVAC system 100 operation in response to the outcome of the comparisons of received data from among multiple sensors 116, 118. For example, the controller 102 may be configured to receive data from one, or more, of the sensors 116 and/or 118 for use in monitoring the compressor, or compressors, 104A, B operation and performance.

Alternatively, or additionally, the controller 102 may be provided with predefined threshold values and/or predefined ranges of values defining safe and/or unsafe operating conditions for the HVAC system 100 and system components. The controller 102 may be implemented with logic for use in controlling the HVAC system 100 in response to the outcome of comparisons between the data received by the controller 102 from one or more sensors 116A, B, and 118 and the predefined threshold values and/or predefined ranges defining safe operating conditions for the HVAC system 100 stored within the controller 102. In such an embodiment, the controller 102 may reconfigure aspects of the HVAC system 100 operations based on the results of the comparisons. Additionally, in such an embodiment, the controller 102 may reconfigure aspects of the logic used by the controller 102 for monitoring operation and performance of the HVAC system 100 components based on the results of data comparisons.

Referring to FIG. 1, in an embodiment, the controller 102 may receive sensed data from one, or both, of the temperature sensors 116A, B for use in monitoring the operation and performance of one, or both, of the compressors 104A, B. For example, the controller 102 may receive data from the temperature sensor 116A for use in monitoring operation of the compressor 104A. Similarly, the controller 102 may receive data from the temperature sensor 116B for use in monitoring operation of the compressor 104B. In such an embodiment, the temperature sensors 116A, B may be thermistors configured to sense the discharge refrigerant temperatures of the compressors 104A, B, respectively. The controller 102 may, additionally, receive sensed data from the pressure sensor 118, which may be a pressure transducer, for use in monitoring the operation and performance of one, or both, of the compressors 104A, B.

In an embodiment, the controller 102 may be configured to use the data received from the temperature sensors 116A, B, in conjunction with other sensed, or calculated data, to calculate, measure, or approximate, operating conditions of the HVAC system 100. For example, the controller may use temperature data received from the temperature sensors 116A, B, along with other data, to calculate compressor sump superheat (CSSH), refrigerant operating pressures, saturation pressures and temperatures, and the like. Methods for calculating, or determining, operational conditions of this sort are known by those of ordinary skill in the relevant art and, thus, are not described herein. The controller may monitor performance of the HVAC system 100, and components thereof, by comparing the operating condition values to tolerance values, or tolerance ranges. The controller 102 may be configured to take some corrective action, or actions, if a tolerance value, or range, is exceeded.

The compressors 104A, B may compress received refrigerant as part of a vapor compression cycle. The compressors 104A, B may be compressors of any type comprising the prior art, such as reciprocating compressors, scroll compressors, and the like. The compressors 104A, B may be single speed or variable speed compressors.

In an embodiment, the compressors 104A, B may be configured to operate as tandem compressors, sharing the common suction pipe 108 and the common discharge pipe 114, as shown in FIG. 1. The compressors 104A, B may be connected to the common suction pipe 108 via the suction ports 109A, B, respectively, which may be brazed to the suction pipe legs 110A, B, respectively. The compressors 104A, B may also be connected to the common discharge pipe 114 via the discharge ports 111A, B, respectively, which may be brazed to the discharge pipe legs 112A, B, respectively.

The compressors 104A, B may each receive refrigerant from the common suction pipe 108, whereby the refrigerant present in each discharge pipe leg 112A, B may be at substantially the same temperature and pressure. During operation, one, or both, of the compressors 104A, B may compress the refrigerant and discharge the refrigerant through the common discharge pipe 114. From the common discharge pipe 114, the refrigerant may flow through a condenser, an expansion device, and an evaporator before returning to the common suction pipe 108.

As shown in the embodiment of FIG. 1, the compressors 104A, B may be provided with the crank case heaters 106A, B, respectively, for preventing refrigerant migration within the compressors 104A, B. The crank case heaters 106A, B may heat the refrigerant within the compressors 104A, B, respectively, to a sufficiently high temperature to prevent condensation of the refrigerant within the compressors 104A, B. The crank case heaters 106A, B may be physically affixed to the compressors 104A, B, respectively. The crank case heaters 106A, B may be operatively connected to the controller 102 via a wired or wireless connection, whereby the controller 102 may selectively energize one, or both, crank case heaters 106A, B, as desired. The operation, design, and function of the crank case heaters 106A, B are known by those skilled in the art and, thus, will not be described herein.

In an embodiment, the HVAC system 100 may be implemented with the temperature sensors 116A, B for directly sensing, calculating, or determining from sensed data through known methods, the HVAC system 100 refrigerant temperature within the portion of refrigerant piping to which the temperature sensors 116A, B are affixed. The temperature sensors 116A, B may be operably connected to the controller 102 via a wired or wireless connection and may communicate sensed data to the controller 102. In an embodiment, the temperature sensors 116A, B may be thermistors. In an alternative embodiment, the temperature sensors 116A, B may be thermocouples, resistive temperature devices, infrared sensors, thermometers, or the like.

In an embodiment, the temperature sensors 116A, B may transmit analog or pneumatic signals either directly, or indirectly, to the controller 102. In such an embodiment, the signals transmitted by the temperature sensors 116A, B may be converted to digital signals prior to use by the controller 102. Alternatively, in an embodiment, the temperature sensors 116A, B may transmit digital signals to the controller 102. In such an embodiment, the digital signals transmitted by the temperature sensors 116A, B may be processed prior to use by the controller 102 to convert the signals to a different voltage, to remove interference from the circuits, to amplify the signals, or other similar forms of digital signal processing. For each alternative described, herein, the signals of the temperature sensors 116A, B may be transmitted to the controller 102 directly or indirectly, such as through one or more intermediary devices.

The temperature sensor 116A may be located on the discharge pipe leg 112A at a point before the discharge pipe leg 112A merges with the discharge pipe leg 112B to form the common discharge pipe 114. Similarly, the temperature sensor 116B may be located on the discharge pipe leg 112B at a point before the discharge pipe leg 112B merges with the discharge pipe leg 112A to form the common discharge pipe 114. In this arrangement, the temperature sensor 116A may sense the temperature of the refrigerant leaving the compressor 104A through the discharge pipe leg 112A, while the temperature sensor 116B may sense the temperature of the refrigerant leaving the compressor 104B through the discharge pipe leg 112B.

As shown in FIG. 1, in an embodiment, the HVAC system 100 may be implemented with the pressure sensor 118 for directly sensing, calculating, or determining from sensed data using known methods, the pressure of the refrigerant in the portion of the HVAC system 100 piping to which the pressure sensor 118 is affixed. The pressure sensor 118 may be operably connected to controller 102 via a wired or wireless connection and may communicate sensed data to the controller 102 in a manner similar to that described, above, in reference to the temperature sensors 116A, B. In an embodiment, the pressure sensor 118 may be a transducer. In an alternative embodiment, the pressure sensor 118 may be any type of pressure detecting device comprising the prior art commonly used in HVAC systems.

The pressure sensor 118 may be located on the common suction pipe 108, as shown in FIG. 1. In this position, the pressure sensor 118 may sense, or calculate, the pressure of the HVAC system 100 refrigerant within the common suction pipe 108. The common suction pressure sensed by the pressure sensor 118 may be substantially the same refrigerant pressure as at the suction ports 109A, B of the compressors 104A, B, respectively. Those skilled in the art will appreciate that the location, and quantity, of the pressure sensor, or sensors, 118 may differ from that shown in FIG. 1, and may be configured to sense refrigerant pressure at different points in the HVAC system 100 for use in accordance with known methods to monitor aspects of the HVAC system 100 components operation and performance.

In the embodiment shown, for example, data sensed by the temperature sensors 116A, B may be used in conjunction with data from the pressure sensor 118 to calculate the CSSH for the compressors 104A, B, respectively, according to known methods. The CSSH value, or values, may be used by the controller 102 to monitoring the operating conditions and performance of one, or both, of the compressors 104A, B to ensure operation in safe conditions, only.

Figure 2:
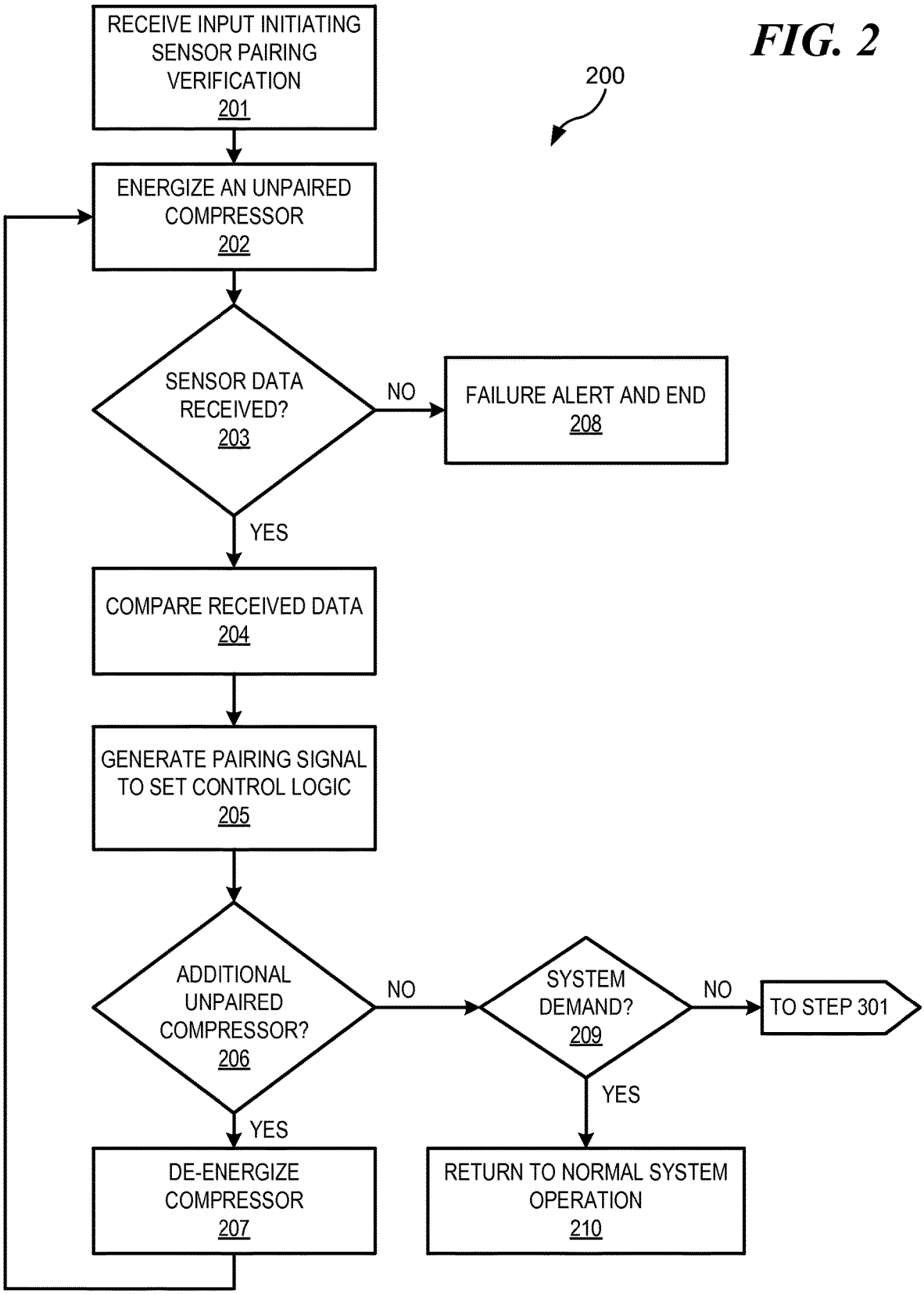
FIG. 2 is a flowchart of a method 200 for setting, or verifying, a compressor and temperature sensor coupling within the HVAC system 100.

Referring to FIG. 2, a flowchart of a method 200 for verifying, or setting, the couplings of one, or more, compressors with one, or more, sensors is shown. In alternative embodiments, fewer, additional, or different steps may be provided than those shown. The method 200 may be performed by controller 102 of the HVAC system 100.

The method 200 may be executed by the controller 102 to pair, within the controller 102 logic, each among the tandem compressors 104A, B with the particular temperature sensor 116A or 116B to which the compressor 104A, B is operably coupled, whereby the controller 102 may associate the data received from the temperature sensor 116A or 116B to the correct compressor 104A or 104B. The method 200 may ensure that the compressors 104A, B operation monitoring logic within the controller 102 is configured to match the actual temperature sensors 116A, B to compressors 104A, B physical couplings within the HVAC system 100.

In some embodiments, prior to execution of the method 200, the controller 102 may be provided with logic predefining one, or more, default logical couplings of temperature sensors 116A, B and compressors 104A, B. In such embodiments, the default couplings may be based on the physical locations of the electrical couplings, such as contactors, connection ports, or the like, to which each temperature sensor 116A, B is coupled. In such embodiments, each of the temperature sensors 116A, B may be logically paired, by default, with the compressor 104A or 104B disposed closest to the location of the electrical coupling to which the temperature sensor 116A or 116B is coupled. In such embodiments, and in instances where the default logical couplings are found to match the actual physical couplings present in the HVAC system 100, the method 200 may verify the default logical couplings.

In instances where the default logical couplings are found to not match the actual physical couplings present in the HVAC system 100, the method 200 may set the logical couplings to match physical couplings present in the HVAC system 100. In such instances, the controller 102 may be configured to alert the user, indicating that one, or more, of the temperature sensors 116A, B is incorrectly placed or, alternatively, disconnected from both of the compressors 104A, B.

In alternative embodiments, prior to execution of the method 200, the controller 102 may not be provided with logic predefining one, or more, default logical couplings of temperature sensors 116A, B and compressors 104A, B. In such embodiments, the method 200 may be used to set the logical couplings of temperature sensors 116A, B and compressors 104A, B to match physical couplings present in the HVAC system 100. The controller 102 may alert the user when any logical temperature sensor 116 and compressor 104 coupling of the HVAC system 100 is verified, or set, using the method 200.

At the step 201, the controller 102 may receive input triggering verifying, or setting, of the logical couplings of the temperature sensors 116A, B and the compressors 104A, B of the HVAC system 100 to correspond to the physical couplings present in the HVAC system 100. The controller 102 may receive such input from a user or from control logic within the controller 102. A user may initiate the method 200 by commanding the HVAC system 100 controller 102 to perform a system diagnostic routine.

The method 200 may be initiated by the controller 102 in response to a partial load demand on the HVAC system 100 requiring operation of one among the compressors 104A, B. The partial load demand may follow a period of no demand upon the HVAC system 100 in which none of the compressors 104A, B were operating. Alternatively, the partial load demand may follow a period demand upon the HVAC system 100 requiring operation of both of the compressors 104A, B. In a further alternative, the method 200 may be initiated by the controller 102 in response to power on of the HVAC system 100 such as during commissioning of the HVAC system 100 or after maintenance requiring removal of power from the HVAC system 100. The method 200, regardless of the triggering event initiating commencement, may, at any time in the method, be abandoned by the controller 102 in response to changes in demand of the HVAC system 100, such as the detection of a full load demand on the HVAC system 100, for example.

At the step 202, the controller 102 may energize one compressor from among the compressors 104A, B while the remaining compressor 104A, B is de-energized, causing heating of the refrigerant within the compressor 104A or 104B energized and within the discharge pipe leg 112A or 112B corresponding to the energized compressor 104A or 104B. The specific compressor amongst the compressors 104A, B energized at the step 202 may depend on the HVAC system 100 configuration and the triggering input initiating the method 200. If the method 200 is initiated in response to a partial load demand on the HVAC system 100, the designated partial load compressor, if provided, may be the compressor 104A, B energized. If the method 200 is initiated in response to another triggering input, either compressor from among the compressors 104A, B that remains unpaired within the controller 102 logic through execution of a first pass through the method 200 may be the compressor 104A, B energized at the step 202.

The energized compressor 104A or 104B may compress the refrigerant passing through it, discharging heated gaseous refrigerant into the corresponding discharge pipe leg 112A, B. The temperature increase of the heated refrigerant may be sensed by the temperature sensor 116A or 116B that is physically coupled to the discharge pipe leg 112A or 112B through which the heated refrigerant is flowing.

At the step 203, the controller 102 may receive data sensed by the temperature sensors 116A, B. In an embodiment, at the step 203, the controller 102 may be configured to receive the data from the temperature sensors 116A, B only after a period of time elapses following the energizing of the compressor 104A or 104B at step 202. This wait time may allow for the heated discharge refrigerant from the energized compressor 104A, B to be sensed by the temperature sensors 116A, B. Additionally, or alternatively, the wait time may allow for cooling of the refrigerant in the discharge pipe leg 112A, B corresponding to the de-energized compressor from among the compressors 104A, B in instances where the method 200 is initiated following a period of full load operation of the HVAC system 100.

In embodiments in which the controller 102 is configured to wait for a defined period of time to elapse before receiving data from the temperature sensors 116A, B at the step 203, the wait time may be a predefined period of time. For example, the controller 102 may be configured to wait for ten minutes following energizing of the compressor 104A, B before receiving data from the temperature sensors 116A, B at the step 203. In alternative embodiments, the predefined wait time may be a period of time in the range of between two and twenty minutes.

If, at the expiration of the predefined wait time, the controller 102 does not receive data from one, or both, of the temperature sensors 116A, B indicating a rise in refrigerant temperature or, alternatively, a temperature differential between the data received, one, or both, of the temperature sensors 116A, B may be diagnosed as inoperable or disconnected. The controller 102 may generate a signal to cause an alert, indicating to the user of a fault condition. The controller may, further, discontinue execution of the method 200 at the step 208.

In alternative embodiments, the controller 102 may be configured to receive, and continuously monitor, data from one, or both, of the temperature sensors 116A, B as soon as the compressor 104A, B is energized at the step 202. In such embodiments, the controller 102 may use received data from one, or both, of the temperature sensors 116A, B for use at the step 204 immediately upon detection of data indicating that a predefined threshold value, which may be a temperature value or a temperature differential, is exceeded. Advantageously, according to such alternative embodiments, faster execution of the method 200 may be possible, as the wait time at the step 203 may be reduced.

In such alternative embodiments, the controller 102 may be implemented with logic defining a timeout period, which may be ten minutes. Alternatively, the timeout period may be within a range of between two and twenty minutes. If, by the expiration of timeout period, the controller 102 has not received data from at least one of the temperature sensors 116A, B indicating that the threshold value is exceeded, one, or both, of the temperature sensors 116A, B may be diagnosed as being inoperable or disconnected. The controller 102 may generate a signal causing an alert, indicating the temperature sensor 116A, B fault condition. The controller may, further, discontinue execution of the method 200 at the step 208.

At the step 204, the controller may compare the data received from one, or both, of the temperature sensors 116A, B. In an embodiment, the data received from the temperature sensor 116A may be compared to the data received from the temperature sensor 116B to determine the temperature sensor 116A, B sensing the higher refrigerant temperature. Alternatively, the controller 102 may compare the data received from one, or both, of the temperature sensors 116A, B to a predefined threshold value which may be stored within the controller 102 memory.

At the step 205, the controller 102 may generate one or more pairing signals which may indicate verified couplings, or non-couplings, and may set operational control and monitoring logic for the HVAC system 100. The temperature sensor 116A, B identified as sensing the greater refrigerant temperature and the currently energized compressor, from among the compressors 104A, B, may be identified as corresponding to a verified physical coupling of a particular compressor 104A or 104B and a particular temperature sensor 116A or 116B within the HVAC system 100. The controller 102 may generate a pairing signal indicating a particular temperature sensor 116A or 116B is coupled to a particular compressor 104A or 104B. The pairing signal may set operational control and monitoring logic of the HVAC system 100 to be in accordance with the set or verified coupling indicated by the pairing signal. The controller 102 may use the data from the particular temperature sensor 116A or 116B identified at the step 204 to monitor operation and performance of the particular compressor 104A or 104B energized at the step 202 in response to the non-pairing signal.

Alternatively, or additionally, the controller 102 may generate a non-pairing signal at the step 205 to indicate a particular temperature sensor 116A or 116B is not coupled to a particular compressor 104A or 104B. The non-pairing signal may delete, or alter, existing operational control and monitoring logic to be in accordance with the non-coupled indicated by the non-pairing signal. The controller 102 may not use the data from the particular temperature sensor 116A or 116B identified at the step 204 to monitor operation and performance of the particular compressor 104A or 104B energized at the step 202 in response to the non-pairing signal.

In an embodiment, having verified, or set, a first temperature sensor 116A or 116B and compressor 104A or 104B first coupling at the step 205, the controller 102 may be configured to automatically generate a second pairing signal for setting operational control and monitoring logic to be in accordance with a second coupling of the HVAC system 100. The second coupling may be assumed by process of elimination in light of the verified first coupling. In such embodiments, the particular temperature sensor 116A or 116B not identified at the step 204 and the particular compressor 104A or 104B not energized at the step 202, may be identified as the second coupling within the HVAC system 100.

In an embodiment, the controller 102 may be configured to automatically set the second coupling, as described above, only in instances where the method 200 was initiated in response to a partial load demand on the HVAC system 100. Advantageously, according to such an embodiment, the step 207 may be effectively bypassed since no additional unpaired compressors may be present in the HVAC system at the step 206. Therefore, the controller 102 may return the HVAC system 100 to normal operation at the step 210 to continue meeting the demand on the HVAC system 100 if a demand on the HVAC system is detected at the step 209. During normal operation of the HVAC system 100, the controller 102 may monitor the operation and performance of the compressors 104A, B using data from the temperature sensors 116A, B, respectively.

In embodiments in which the second coupling is not automatically configured, the controller 102 may determine whether an additional unpaired compressor 104A, B, or an unverified default coupling is present in the HVAC system 100 at the step 206. The controller 102 may de-energize the energized compressor 104A, B at the step 207 if an unpaired compressor 104 or unverified default coupling is present in the HVAC system 100 and return to the step 202 to verify, or set, the remaining coupling, as described above.

Alternatively, if the controller determines at the step 206 that no unpaired compressor 104A, B, or unverified default coupling remains, the controller 102 may check for a current demand on the HVAC system 100 requiring energizing of one, or more, of the compressors 104A, B at the step 209. If a demand exists, the controller 102 may return the HVAC system 100 to normal operation to respond to the demand at the step 210. During normal operation of the HVAC system 100, the controller 102 may monitor the operation and performance of the compressors 104A, B using data from the temperature sensors 116A, B, respectively.

If no current demand is detected by the controller 102 at the step 209 the controller 102 may de-energize the compressor 104A, B and, in an embodiment, may proceed to step 301 of the method 300 for verifying, or setting, the crank case heater 106A, B and the compressor 104A, B couplings. In alternative embodiments, the controller 102 may be configured to return the HVAC system 100 to normal operation regardless of whether a demand on the HVAC system is present. In such embodiments, the method 200 may proceed directly to step 210 once all of the compressors 104 are paired, bypassing the step 209.

Figure 3:
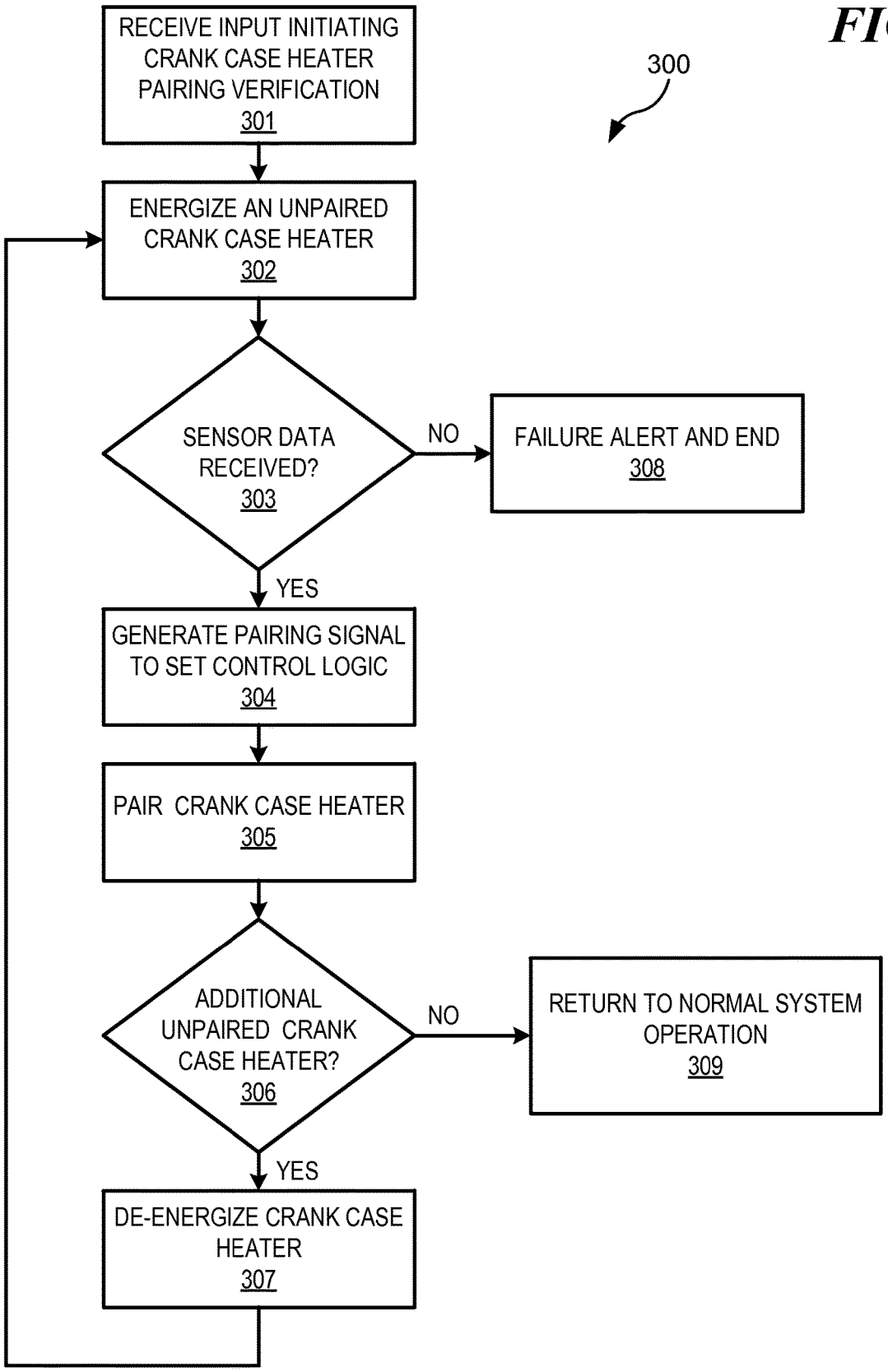
FIG. 3 is a flowchart of a method 300 for setting, or verifying, a compressor and crank case heater coupling within the HVAC system 100.

Referring to FIG. 3, a method 300 for coupling each among the crank case heaters 106A, B with the compressor 104A, B to which the crank case heater 106A, B is affixed is shown. In an alternative embodiment of the method 300, fewer, additional, or different steps may be provided. In an embodiment, the method 300 may be performed by controller 102 of the HVAC system 100.

The steps 301-307 of the method 300 may closely mirror the steps 201-207 of the method 200. At the step 301, the method 300 may be initiated from triggering inputs similar to those discussed above, and in reference to the step 201 of the method 200. Additionally, the method 300 may be initiated by logic within the controller 102 commanding execution of the method 300 following completion of the method 200 in instances where no demand on the HVAC system 100 is detected at the step 209 of the method 200. Regardless of the triggering input initiating commencement of the method 300, however, the controller 102 may, at any point in the execution of the method 300, discontinue execution of the method 300 in response to a demand placed on the HVAC system 100 requiring energizing of at least one of the compressors 104A, B.

At the step 302, the controller 102 may selectively energize one crank case heater 106A, B to cause heating of the refrigerant within the compressor 104A or 104B to which the energized crank case heater 106A or 106B is coupled as well as the refrigerant within the discharge pipe leg 112A or 112B corresponding to the compressor 104A or 104B to which the energized crank case heater 106A or 106B is coupled. The refrigerant temperature increase may be sensed by the temperature sensors 116A or 116B which is coupled to the discharge pipe leg 112A or 112B of the compressor 104A or 104B to which the energized crank case heater 106A or 106B is coupled.

At the step 303, the controller may receive sensed data from one, or both, of the temperature sensors 116A, B. The controller 102 may be configured to receive the sensed data only after the expiration of a defined period of time before to allow for cooling and/or heating of the refrigerant within the discharge port legs 112A, B. If unexpected data is sensed, such as, for example, the temperature sensors 116A, B sensing data indicating that the temperature of the respective discharge port legs 112A, B closely match one another, the controller 102 may generate an alert signal indicating a crank case heater 106A, B failure and may terminate the method 300 at the step 308. Similarly, and as described in reference to the steps 203 and 208 above, if the controller 102 times out before receiving acceptable data from the temperature sensors 116A, B, the controller 102 may generate an alert signal indicating a crank case heater 106A, B failure and may terminate the method 300 at the step 308.

At the step 304, the controller 102 may compare the sensed temperature data from the temperature sensors 116A, B to determine the temperature sensor 116A or 116B sensing the higher refrigerant temperature. The controller 102 may, at the step 305, generate one or more pairing signals which may indicate verified couplings, or non-couplings, and may set operational control and monitoring logic for the HVAC system 100. The controller 102 may set or verify the coupling of the energized crank case heater 106A or 106B within the operational and control logic to correspond to the physical coupling identified within the HVAC system 100. The energized crank case heater 106A or 106B may be set, or verified, as being coupled with the compressor 104A or 104B to which the temperature sensor 116A or 116B, identified as sensing the higher temperature data, is coupled. The controller 102 may generate a control signal for setting operational logic to be in accordance with the verified coupling. Alternatively, or additionally, the controller 102 may generate a control signal not setting operational logic to be in accordance with an unverified coupling. The controller 102 may check for additional unpaired crank case heaters 106A, B at the step 306. If additional unpaired crank case heaters 106 are detected, the controller 102 may de-energize any energized crank case heaters 106A, B at the step 307 and return to the step 302.

Alternatively, in an embodiment, having verified, or set, a first crank case heater 106A, B coupling at the step 305, the controller 102 may be configured to automatically set the second crank case heater 106A, B coupling of the HVAC system 100. In such embodiments, the unpaired crank case heater 106A, B may be paired to the paired compressor 104A, B and temperature sensor 116A, B which includes the temperature sensor 116A, B not identified as sensing the higher temperature data at the step 304. The controller 102 may set operational monitoring logic to be in accordance with the second coupling.

Once all of the crank case heaters 106A, B are paired, the controller 102 may return the HVAC system 100 to normal operation at the step 309, which may require energizing, or de-energizing of one, or more of the crank case heaters 106A, B.

Those skilled in the art will appreciate that it may be desirable to bypass, or interrupt, execution of the method 300 in certain instances. For example, if a heating or cooling demand is placed on the HVAC system 100, it may be desirable to forego the method 300 to avoid interruption, or delay, of the HVAC system 100 in meeting the heating or cooling demand. The controller 102 may be implemented with logic for bypassing, or discontinuing, the method 300 at such times.

An HVAC system, such as the HVAC system 100 shown in FIG. 1, having two compressors 104A, B configured for tandem operation, with each compressor 104A, B provided with a temperature sensor 116A, B, respectively. The temperature sensors 116A, B may be coupled to the discharge pipe legs 112A, B, respectively, of the compressors 104A, B. The compressors 104A, B may be provided with the crank case heaters 106A, B, respectively. The controller 102 may control the HVAC system 100 and execute the methods 200 and 300, as follows.

The HVAC system 100 may receive input initiating verifying, or setting, of temperature sensor and compressor couplings upon the HVAC system receiving a partial load demand for cooling supply air. The HVAC system 100 controller 102 may energize a first compressor 104A from among the tandem compressors. The controller 102 may wait until a predefined period of time has elapsed, perhaps ten minutes, to allow for the refrigerant flowing within the discharge port leg 112A to be heated. The heated refrigerant within the discharge port leg 112A may be sensed by the temperature sensor 116A when the temperature sensor 116A is coupled to the discharge port leg 112A. The controller 102 may receive data from the temperature sensors 116A, B at the expiration of the waiting time.

The controller 102 may compare the data received to determine that the temperature sensor 116A as sensing a higher refrigerant temperature. The controller 102 may then configure the compressor 104A operation and performance monitoring logic to associate the data received from the temperature sensor 116A identified as sensing a higher refrigerant temperature to the compressor 104A. The controller 102 may then determine that an unpaired compressor, the compressor 104B, is present in the HVAC system 100.

The controller 102 may de-energize the compressor 104A, stopping flow of heated gaseous refrigerant through the discharge port leg 112A. The controller 102 may energize the compressor 104B. The controller 102 may wait for predefined period of time to elapse, perhaps ten minutes, allowing the discharge port leg 112B to be heated by the heated gas refrigerant flowing through the discharge port leg 112B. The discharge port leg 112A may cool during the waiting time. The controller 102 may receive data from the temperature sensors 116A, B upon expiration of the wait time. The controller 102 may compare the data received and may determine the temperature sensor 116A or 116B sensing a higher refrigerant temperature, the temperature sensor 116B, perhaps. The controller 102 may then configure the compressor 104B operation and performance monitoring logic to associate the data received from the temperature sensor 116B to the compressor 104B.

The controller 102 may determine that no remaining unpaired compressors 104 are present in the HVAC system 100 and may return the HVAC system 100 to normal operation to meet a demand on the HVAC system 100. The controller 102 may return the HVAC system 100 to normal operation without continuing to the method 300. This may be desirable to avoid interruption to the HVAC system 100 operation in response to a heating or cooling demand, as execution of the method 300 may require de-energizing the HVAC system 100 compressors 104A, B.

Alternatively, the HVAC system 100 controller 102 may continue to the method 300 if the controller 102 determines that no remaining unpaired compressors 104 are present in the HVAC system 100 and there is no current demand on the HVAC system 100. Additionally, the controller 102 may be configured to continue to execution of the method 300 following completion of the method 200 following initial power on of the HVAC system 100.

Once the controller 102 returns the HVAC system 100 to normal operation following execution of the method 200, or following the methods 200 and 300, the controller 102 may utilize the data received from the temperature sensor 116A, B to monitor the operation and performance of the compressors 104A, B, respectively. The controller 102 may associate the data received from the temperature sensor 116A to the compressor 104A, while the data received from the temperature sensor 116B may be associated to the compressor 104B, in accordance with the logical coupling configuration resulting from the controller 102 executing the method 200. In the HVAC system 100, for example, provided with a suction pressure transducer, the pressure sensor 118, that may be disposed on the common suction pipe 108, the controller 102 may use the data received from the temperature sensors 116A, B, along with the sensed suction pressure data received from the pressure sensor 118 to calculate the CSSH for the compressors 104A, B, individually, for independent monitoring of the operation and performance of the compressors 104A, B.

In the previous discussion, numerous specific details are set forth to provide a thorough understanding of the present invention. However, those skilled in the art will appreciate that the present invention may be practiced without such specific details. In other instances, well-known elements have been illustrated in schematic or block diagram form in order not to obscure the present invention in unnecessary detail. Additionally, for the most part, details concerning well-known features and elements have been omitted inasmuch as such details are not considered necessary to obtain a complete understanding of the present invention, and are considered to be within the understanding of persons of ordinary skill in the relevant art.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of other features. Many such variations and modifications may be considered desirable by those skilled in the art based upon a review of the foregoing description of preferred embodiments.

The invention claimed is:

1. An apparatus for verifying that one or more sensors are coupled to an associated compressor of an HVAC system, comprising:

a first compressor having a first discharge pipe leg coupled to a discharge port of the first compressor;

a second compressor having a second discharge pipe leg coupled to a discharge port of the second compressor, wherein the second discharge pipe leg merges with the first discharge pipe leg to form a common discharge pipe shared by the first and second compressors;

a first sensor coupled to the first discharge pipe leg, the first sensor configured to transmit a first signal to a location remote to the first sensor, the first signal indicating one or more temperatures of refrigerant within the first discharge pipe leg;

a controller implemented with logic, wherein the logic is configured to compare data received by the controller from the first sensor, wherein the controller is operably coupled to the first and second compressors to switch each of the first and second compressors between energized and de-energized states, the controller having a control configuration comprising: causing a temperature increase of the refrigerant within the first discharge pipe leg of the first compressor;

receiving from the first sensor the first signal indicating one or more temperatures of refrigerant within the first discharge pipe legs;

determining whether the first signal indicates one or more temperatures above a threshold value;

if the first signal indicates one or more temperatures above the threshold value, generating a first pairing signal indicating the first sensor is coupled with the first compressor; and if the first signal indicates one or more temperatures below the threshold value, generating a second pairing signal, wherein the controller is configured to determine that the first sensor is not coupled with the first compressor in response to generating the second pairing signal.

2. The apparatus of claim 1, wherein the control configuration further comprises:

energizing the first compressor while de-energizing and maintaining the second compressor in a de-energized state causing a temperature increase of the refrigerant within the first compressor, whereby compressed and heated gaseous refrigerant flows through the first discharge leg.

3. The apparatus of claim 1, further comprising:

a second sensor coupled to the second discharge pipe leg, the second sensor configured to transmit a second signal to a location remote to the second sensor, the second signal indicating one or more temperatures of refrigerant within the second discharge pipe leg.

4. The apparatus of claim 3, wherein the threshold value to which the first signal is compared comprises one or more temperatures of refrigerant within the second discharge pipe leg indicated by the second signal.

5. The apparatus of claim 3, wherein the first and second sensors are thermistors.

6. The apparatus of claim 4, further comprising:

a first crank case heater coupled to the first compressor and configured to heat the refrigerant within the first compressor when the first crank case heater is energized, wherein one or more temperatures of refrigerant within the first compressor are indicated by the first signal transmitted by the first sensor when the first sensor is coupled to the discharge port of the first compressor;

a second crank case heater coupled to the second compressor and configured to heat the refrigerant within the second compressor when the second crank case heater is energized, wherein one or more temperatures of refrigerant within the second compressor are indicated by the second signal transmitted by the second sensor when the second sensor is coupled to the discharge port of the second compressor;

the controller operably coupled to switch each of the first and second crank case heaters between energized and de-energized states, wherein the control configuration further comprises:

energizing the first crank case heater while de-energizing and maintaining the second crank case heater in a de-energized state causing a temperature increase of the refrigerant within the first compressor;

receiving from the first and second sensors the first and second signals indicating one or more temperatures of refrigerant within the first and second discharge pipe legs;

identifying which of the first and second signals indicates a higher temperature;

if the first signal indicates one or more temperatures higher than the one or more temperatures indicated by the second signal, generating a third pairing signal indicating the first crank case heater is coupled with the first compressor; and if the first signal indicates one or more temperatures not higher than the one or more temperatures indicated by the second signal, generating a pairing fourth signal indicating the first crank case heater is not coupled with the first compressor.

7. The apparatus of claim 1, wherein the control configuration further comprises:

the controller receiving a triggering input signal and, in response to the triggering input signal, causing a temperature increase of the refrigerant within the first discharge pipe leg of the first compressor.

8. The apparatus of claim 7, wherein the triggering input signal indicates a partial load demand on the HVAC system.

9. The apparatus of claim 7, wherein the triggering input signal indicates an initial powering of the HVAC system.

10. The apparatus of claim 7, wherein the triggering input signal indicates a command for diagnostic testing of the HVAC system.

11. The apparatus of claim 4, wherein the control configuration further comprises:

after expiration of a period of time following energizing the first compressor while de-energizing and maintaining the second compressor in a de-energized state, identifying which of the received first and second signals indicates a higher temperature.

12. The apparatus of claim 3, wherein the control configuration further comprises:

monitoring, if the first pairing signal is generated, operation of the first compressor using the first signal.

13. The apparatus of claim 12, further comprising:

the first compressor having a first suction pipe leg coupled to a suction port of the first compressor;

the second compressor having a second suction pipe leg coupled to a suction port of the second compressor;

wherein the first and second suction pipe legs each diverge from a common suction pipe shared by the first and second compressors; and a third sensor coupled to the common suction pipe, the third sensor configured to transmit a third signal to a location remote to the third sensor, the third signal indicating one or more pressures of refrigerant within the common suction pipe.

14. The apparatus of claim 13, wherein the control configuration further comprises:

determining, if the first pairing signal is generated, a superheat temperature of the refrigerant within the first compressor using at least the first signal indicating one or more temperatures of refrigerant within the first discharge pipe leg and at least the third signal indicating one or more pressures of refrigerant within the common suction pipe.

15. A method of verifying the couplings of one or more sensors to an associated compressor of an HVAC system, the method comprising:

coupling a first discharge pipe leg to a discharge port of a first compressor;

coupling a second discharge pipe leg to a discharge port of a second compressor;

coupling the first and second discharge pipe legs to a common discharge pipe shared by the first and second compressors;

coupling a first sensor to the first discharge pipe leg, the first sensor configured to transmit a first signal to a location remote to the first sensor, the first signal indicating one or more temperatures of refrigerant within the first discharge pipe leg;

operably coupling a controller to the first and second compressors, wherein the controller is implemented with logic, wherein the logic is configured to compare data received by the controller from the first sensor, wherein the controller is operably coupled to the first and second compressors for switching each of the first and second compressors between energized and de-energized states;

coupling the controller to the first sensor for receiving the first signal indicating one or more temperatures of refrigerant within the first discharge pipe leg, causing, using the controller, temperature increase of the refrigerant within the first discharge pipe leg of the first compressor;

receiving, using the controller, the first signal from the first sensor indicating one or more temperatures of refrigerant within the first discharge pipe leg;

determining, using the controller, whether the first signal indicates one or more temperatures above a threshold value;

responive to a determination that the first signal indicates one or more temperatures above the threshold value, generating, using the controller, a first pairing signal indicating the first sensor is coupled with the first compressor;

determining, using the controller, whether the first signal indicates one or more temperatures below the threshold value; and responsive to a determination that the first signal indicates one or more temperatures below the threshold value, generating, using controller, a second pair signal, wherein the controller is configured to determine that the first sensor is not coupled with the first compressor in response to generating the second pairing signal.

16. The method of claim 15, further comprising:

coupling a second sensor to the second discharge pipe leg, the second sensor configured to transmit a second signal to a location remote to the second sensor, the second signal indicating one or more temperatures of refrigerant within the second discharge pipe leg;

coupling the controller to the second sensor for receiving the second signal indicating one or more temperatures of refrigerant within the second discharge pipe leg; and receiving, using the controller, the second signal from the second sensor indicating one or more temperatures of refrigerant within the second discharge pipe leg.

17. The method of claim 16, wherein the threshold value to which the first signal is compared comprises one or more temperatures of refrigerant within the second discharge pipe leg indicated by the second signal.

18. The method of claim 17, wherein the first and second sensors are thermistors.

19. The method of claim 16, further comprising:

coupling a first suction pipe leg to a suction port of the first compressor;

coupling a second suction pipe leg to a suction port of the second compressor;

coupling the first and second suction pipe legs to a common suction pipe shared by the first and second compressors;

coupling a third sensor to the common suction pipe, the third sensor configured to transmit a third signal to a location remote to the third sensor, the third signal indicating one or more pressures of the refrigerant within the common suction pipe;

coupling the controller to the third sensor for receiving the third signal;

receiving, using the controller, the third signal indicating one or more pressures of the refrigerant within the common suction pipe; and determining, using the controller, a superheat temperature of the refrigerant within the first compressor in response to the first pairing signal being generated using at least the first signal indicating one or more temperatures of refrigerant within the first discharge pipe leg and at least the third signal indicating one or more pressures of refrigerant within the common suction pipe.

20. The method of claim 15, further comprising:

receiving, controller, a triggering input signal and in response to the triggering input signal causing a temperature increase of the refrigerant within the first discharge pipe leg of the first compressor.

21. The method of claim 20, wherein the triggering input signal indicates a partial load demand on the HVAC system.

22. The method of claim 20, wherein the triggering input signal indicates an initial powering of the HVAC system.

23. The method of claim 20, wherein the triggering input signal indicates a command for diagnostic testing of the HVAC system.

24. The method of claim 15, further comprising:

the controller generating an alert signal indicating that the first sensor is not coupled to the first compressor in response to the second pairing signal being generated.

* * * * *